United States Patent [19]

Olsson et al.

[11] Patent Number: 4,650,413

[45] Date of Patent: Mar. 17, 1987

[54] METHOD AND APPARATUS FOR ACTIVATING FLUIDS

[75] Inventors: Mats Olsson, Bromma; Roland Sandström, Skellefteå, both of Sweden

[73] Assignee: ASEA Stal AB, Finspong, Sweden

[21] Appl. No.: 677,526

[22] Filed: Nov. 30, 1984

[30] Foreign Application Priority Data

Dec. 2, 1983 [SE] Sweden ..... 8306653

[51] Int. Cl.[4] ..... F23C 11/04

[52] U.S. Cl. ..... 431/1; 431/183; 431/186; 60/39.77; 239/4; 239/102

[58] Field of Search ..... 431/1, 2, 157, 182, 431/183, 186, 187; 122/24; 110/265; 239/4, 102; 60/39.77

[56] References Cited

U.S. PATENT DOCUMENTS

| | | | |
|---|---|---|---|
| 2,945,459 | 7/1960 | Junkermann | 110/265 |
| 3,690,807 | 9/1972 | Paxton et al. | 431/1 |
| 3,861,852 | 1/1975 | Berger | 431/1 |
| 3,938,932 | 2/1976 | Benzan | 431/2 |
| 4,359,962 | 11/1982 | Olsson et al. | 181/0.5 X |
| 4,458,842 | 7/1984 | Keller | 239/102 |

FOREIGN PATENT DOCUMENTS

| | | | |
|---|---|---|---|
| 567015 | 8/1977 | U.S.S.R. | 431/1 |

*Primary Examiner*—Margaret A. Focarino

*Attorney, Agent, or Firm*—Watson, Cole, Grindle & Watson

[57] ABSTRACT

The invention relates to method and apparatus for the combustion of fluidal fuels. The fuel is dispersed in combustion air and, in order to improve the combustion rate and efficiency, is exposed to a high particle velocity of a sound produced by a low frequency sound generator. The frequency of the sound is determined by the sound generator, the maximum frequency being 30 Hz. A reciprocating movement of combustion air and fuel particles entrained therein is obtained. The sound generator is a quarter wave type sound generator with a tubular resonator forming a diffuser at the open end thereof.

6 Claims, 4 Drawing Figures

METHOD AND APPARATUS FOR ACTIVATING FLUIDS

BACKGROUND OF THE INVENTION

The present invention relates to a method and an apparatus for the combustion of liquid, gaseous or atomized fuels, hereafter referred to as fluidal fuels.

As early as in 1961 F. H. Reynst mentioned that it had been recently recognized that acoustic vibrations have a beneficial effect on combustion. In this connection reference is made to Pulsating Combustion, pp. 13–15, The Collected Works of F. H. Reynst, Pergamon Press, New York 1961. Although the vibrations may be only very weak, the relative motion of the gas with respect to the fuel particle which results is sufficient to remove the envelope of combustion products around this particle, resulting in an increase of the combustion rate. Reynst describes the application of this principle to a pulverized coal burner. A mixture of fuel and air is delivered by a fan to a precombustion chamber located between two conical passages flaring in the direction of flow. Volatile components of the fuel are combusted in the precombustion chamber, and the flame is directed into a flame tube. The pulsations of the flame in the precombustion chamber are propagated into the flame tube, wherein the column of gas is set in resonance so as to move relatively with respect to the fuel particles, which speeds up the combustion as mentioned above.

Swedish patent specification No. 7701764-8 (publ. No. 412 635) describes a method of combusting atomized solid, liquid or gaseous fuels, which is based on the principle mentioned by Reynst. According to this patent specification, the vibrations are not generated by the burner flame. Sound energy is supplied to the combustion flame by external means such as a sound emitter, the frequency of the sound ranging from infrasonic frequencies to ultrasonic frequencies. However, the method of Swedish patent specification 7701764-8 apparently has not yet been utilized in practice to any significant extent, which may indicate that it has not been possible so far to develop the method for industrial application.

Similar methods are described in Swiss patent specification No. 281,373 and German patent specification No. 472,812. According to the Swiss patent specification, vibration is imparted to at least part of the combustion chamber and the flue gases, and according to the German patent specification, a dispersion of particulate fuel and combustion air as well as secondary combustion air is brought to oscillate.

The USSR Author's Certificate No. 228,216 (V. S. Severyanin) describes a pulsating combustion in a bed whereby the hot grid of the Rijke tube is replaced by a layer of solid fuel in which free oscillation will develop. The effect obtained is, however, relatively low, because only self-generated oscillation is utilized.

U.S. Pat. No. 2,945,459 discloses a pulsating combustion method and apparatus wherein pulsating air is supplied to a combustion chamber forming part of a resonance tube receiving the pulsating air. The resonance frequency of the tube is adjusted by means of a plunger closing one end of the tube, the other end being open. The fuel to be combusted is supplied to the air in the resonance tube between the ends thereof.

SUMMARY OF THE INVENTION

The primary object of the present invention is to provide a method for the combustion of fluidal fuels, wherein the fuel is dispersed in combustion air and is exposed to sound produced by a sound generator having a tubular resonator with closed and open ends, which further improves the beneficial effect of sound on combustion and which can be industrially applied in a practical manner.

By this method the maximum velocity of the reciprocating air in the resonator, the particle velocity, will be obtained at the open end of the resonator due to the fact that a stand quarter wave will be obtained in the tubular resonator when the generator is operated at the fundamental tone of the resonator. Thus, it is achieved that the fuel particles are oscillated by the reciprocating air column produced by the sound generator such that the fuel particles will be more intimately entrained into the air and thus the combustion rate will be increased. As a consequence thereof the flame will be shorter than in case of no sound activation being applied.

This is contrary to the method disclosed in the U.S. Pat. No. 2,945,459 referred to above wherein the frequency of the air pulses fed into the resonance tube is not defined and in any case is not defined as the fundamental tone. Moreover, the position where the fuel is supplied to the resonance tube is defined as the position where the particle velocity is at maximum.

DESCRIPTION OF THE DRAWINGS

For the explanation of the invention in more detail, reference is made to the accompanying drawings wherein.

DETAILED DESCRIPTION OF THE PREFERRED EMBODIMENT

Figure 1:
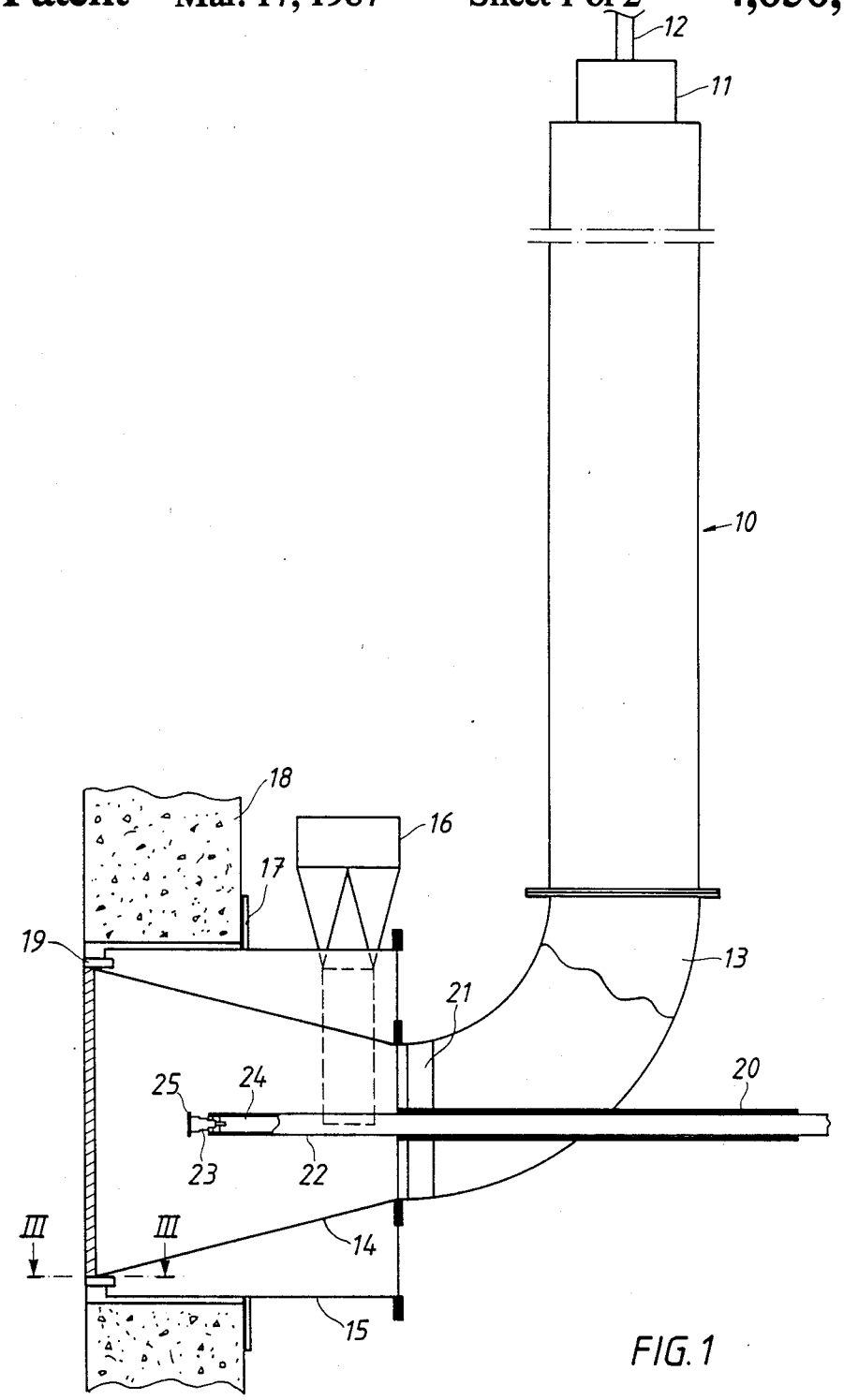
FIG. 1 is an axial sectional view of an apparatus for working the method of the invention, connected to a boiler.
Figure 2:
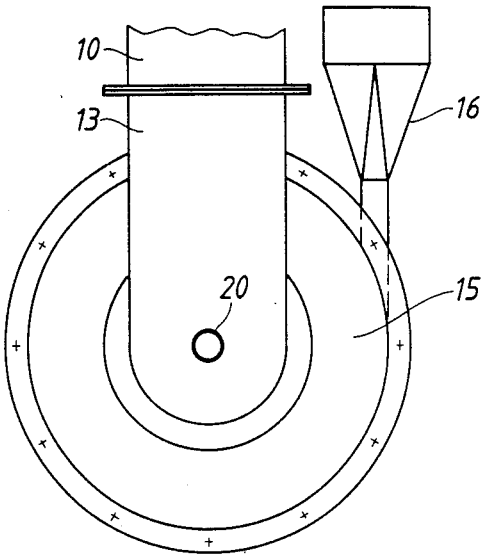
FIG. 2 is a fragmentary end view of the apparatus.
Figure 3:
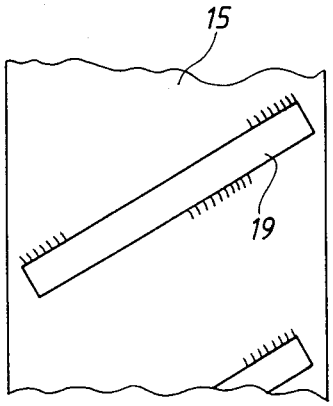
FIG. 3 is an enlarged fragmentary cross-sectional view along line III to III in FIG. 1.

The burner shown in FIGS. 1 to 3 comprises a tubular resonator 10, the length of which is a quarter of the wave length of the sound emitted. A feeder 11, herein termed exigator for the purpose of this specification, is arranged at one end of the resonator and forms a low frequency sound generator, the exigator being connected to a supply conduit 12 for driving gas. The generator can be an infrasound generator of the positive feedback type described in U.S. Pat. No. 4,359,962. However, any other infrasound generator can be used for the purpose of the invention.

At the other end the resonator 10 forms a 90° bow 13 and terminates in a diffuser 14, the bow and the diffuser forming part of the quarter wave resonator. The diffuser is surrounded by an air jacket 15 provided with a tangential inlet 16 for pressurized combustion air. At an annular flange 17 on the jacket the burner is mounted to the outside of a boiler wall indicated at 18 in FIG. 1, the outlet of the diffuser 14 being substantially flush with the inside surface of the wall 18. Around the outlet of the diffuser 14 the jacket 15 forms an annular outlet opening, vanes 19 being provided in the annular opening to form spacers between the jacket and the diffuser. As shown in FIG. 3 these vanes 19 are angled to the axial direction of the diffuser to impart to combustion air discharged from the air jacket 15 through the annular outlet opening thereof, a rotational movement about the axis of the diffuser.

A guide tube 20 extends through the bow 13 along the axis of the diffuser 14 and is mounted in the bow by means of arms 21.

A lance 22 for the supply of fluidal fuels is displacably received by the guide tube 20 to be adjusted in the axial direction thereof. In the embodiment shown the lance 22 is arranged for the supply of pulverized coal, and is provided at the outlet end thereof, opening in the diffuser, with a conical body 23, which is mounted in the lance 22 by means of arms 24 and the apex of which faces the interior of the lance. At the base of the conical body 23 an annular flange 25 is provided such that pulverized coal which is supplied through the lance carried by pressurized air and entrained therein will be diverted by the conical body 23 and the flange 25 associated therewith, substantially in the radial direction towards the periphery of the diffuser 14. The lance 22 can be adjusted axially so as to supply the fuel at an optimal location in the diffuser.

The outlet end of the lance 22 can be arranged in other ways than that disclosed herein for the supply of fluidal fuels of other types such as pulverized peat, wood dust, coal-water slurry, or other slurries containing coal, or other slurries, oil, or gas. In case of pulverized coal, this is supplied by means of pressurized air to be dispersed in the air. The air thus supplied together with the fuel is supplemented by the air supply through the resonator 10 for operating the exigator 11, and further combustion air is supplied through the inlet 16 via the air jacket 15 to be discharged through the annular outlet opening thereof.

Preferably, the resonator 10 of the low frequency sound generator is of the quarter wave length type and is operated at its fundamental tone, having a frequency of a maximum of 60 Hz, preferably the maximum frequency should be 30 Hz; however, 20 Hz or less would be optimal. Lance 22 is adjusted such that the supply of the fuel takes place at an optimal position in the diffuser 15. The particles of the fluid supplied as well as air and other gas in the area at the opening of the resonator accordingly are given a reciprocating movement under the influence of the sound, the combustion of the fuel being intensified by such movement.

Figure 4:
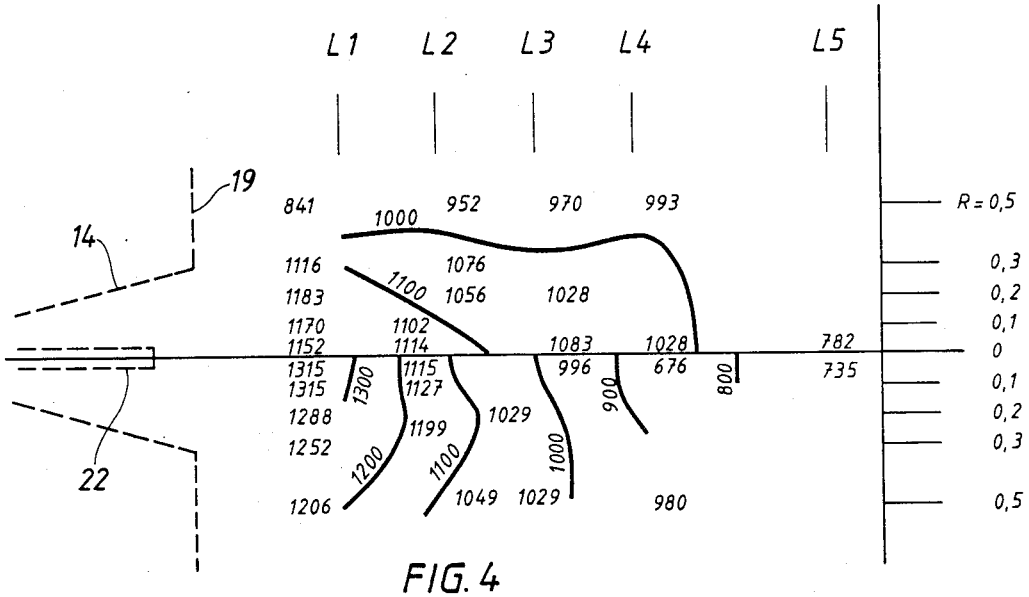
FIG. 4 is a diagram showing isotherms in the flame when oil is being burnt with and without sound activation.

It has been found that the fuel supplied will be rapidly combusted when exposed to the low-frequency sound at the opening of the tubular resonator and that the content of unburnt particles in the fume gases will be low also when the excess of combustion air is very low. The flame from the burner will be shorter than in case of a conventional burner, which is advantageous, e.g., when it is desired to convert a boiler for combustion of oil to a boiler for combustion of pulverized coal. This is illustrated by the diagram of FIG. 4, wherein the horizontal axis represents the axial length of the diffuser 14 and the vertical axis represents the radial distance from the axes of the diffuser. Above the horizontal axis the isotherms are shown for burning oil without activation by means of low frequency sound being applied, and below the horizontal axis the isotherms are shown for burning oil when low frequency sound activation is applied in accordance with the invention. As will be seen from the diagram, the length of the flame is substantially shorter when sound activation is applied than in case of no sound activation. It has also been found that the flame is partly drawn into the resonator when this is terminated by a diffuser, which also contributes to shortening of the flame. As will be seen from the diagram the temperature at the base of the flame will be increased by sound activation, but due to the fact that the diffuser is cooled by combustion air supplied through the jacket, the diffuser can stand this higher temperature without being made of an exclusive heat resistant material.

For the achievement of the greatest efficiency aimed at by the invention, the frequency of the low frequency sound generator should be chosen such that the length of the flame is less than a quarter of the wave length of the sound.

It has also been found that the content of nitrogen oxides with flue gas is lower than in case of no sound activation, which is another advantage achieved by a low frequency sound.

We claim:

1. A method of burning particulate fuels with combustion air in a combustion apparatus that includes a low frequency sound generator which provides a reciprocating movement to the combustion air and the fuel particles entrained therein, the low frequency sound generator including a resonator which has a closed end and an open end and has a fundamental tone, the maximum frequency of the fundamental tone being 60 Hz, the method including the steps of (1) operating said sound generator at the fundamental tone of said resonator, and (2) supplying combustion air and said particulate fuel to the resonator at a point where the particle velocity from the sound produced by said resonator will be substantially at a maximum so that said particulate material will become entrained in said combustion air and thereafter combust.

2. The method as defined in claim 1, including the step of passing at least a first portion of said combustion air through said resonator.

3. The method as defined in claim 2, including the step of passing a second portion of said combustion air around said open end of said resonator as a circular curtain.

4. The method as defined in claim 3, wherein the open end of said resonator defines an axial line therethrough, and wherein said second portion of said combustion air is caused to rotate around said axial line.

5. A combustion apparatus for burning fluidal fuels, said combustion apparatus including a quarter wave-type sound generator which includes (a) a resonator having a closed end and an open end, a portion of said resonator being tubular, and (b) a diffuser at the open end of said resonator, said diffuser defining an outlet and an axial line therethrough, a lance for supplying the fluidal fuels to be burned to the interior of said diffuser, said lance being movable along said axial line, and an air jacket surrounding said diffuser, said air jacket providing an annular outlet opening around the outlet of said diffuser.

6. The combustion apparatus as defined in claim 5, including vanes mounted in the annular outlet opening of said air jacket, said vanes being inclined with respect to said axial line defined by said diffuser.

* * * * *